US005489504A

United States Patent [19]

Takada

[11] Patent Number: 5,489,504

[45] Date of Patent: Feb. 6, 1996

[54] SILVER HALIDE PHOTOGRAPHIC EMULSION AND SILVER HALIDE PHOTOGRAPHIC LIGHT SENSITIVE MATERIAL APPLIED THEREWITH

[75] Inventor: Hiroshi Takada, Hino, Japan

[73] Assignee: Konica Corporation, Tokyo, Japan

[21] Appl. No.: 77,285

[22] Filed: Jun. 14, 1993

[30] Foreign Application Priority Data

Jun. 23, 1992 [JP] Japan ..... 4-187320

[51] Int. Cl.[6] ..... G03C 1/015

[52] U.S. Cl. ..... 430/569; 430/603

[58] Field of Search ..... 430/567, 569, 430/603

[56] References Cited

U.S. PATENT DOCUMENTS

| | | | |
|---|---|---|---|
| 5,004,679 | 4/1991 | Mifune et al. | 430/567 |
| 5,110,719 | 5/1992 | Shuto et al. | 430/567 |
| 5,244,781 | 9/1993 | Takada | 430/567 |
| 5,358,339 | 10/1994 | Fukazawa | 430/567 |
| 5,358,842 | 10/1994 | Kasai et al. | 430/569 |
| 5,372,975 | 12/1994 | Ishikawa et al. | 430/569 |

FOREIGN PATENT DOCUMENTS

| | | | |
|---|---|---|---|
| 371338 | 6/1990 | European Pat. Off. | 430/569 |

*Primary Examiner*—Janet C. Baxter
*Attorney, Agent, or Firm*—Frishauf, Holtz, Goodman, Langer & Chick

[57] ABSTRACT

A silver halide photographic emulsion which is improved in photographic speed, fog and graininess is provided, comprising a dispersion medium and light-sensitive silver halide grains, wherein said silver halide grains are formed, in the presence of an oxidizing agent at a time during the course of forming said silver halide grains, by supplying an emulsion comprising silver halide fine grains formed in the presence of dispersion medium.

8 Claims, 2 Drawing Sheets

SILVER HALIDE PHOTOGRAPHIC EMULSION AND SILVER HALIDE PHOTOGRAPHIC LIGHT SENSITIVE MATERIAL APPLIED THEREWITH

FIELD OF THE INVENTION

This invention relates to a silver halide emulsion and to a silver halide photographic light sensitive material applied with the emulsion, each of which is useful in photographic field. The invention also relates particularly to a silver halide emulsion low in fog density and excellent in graininess and to a silver halide photographic light sensitive material applied with said emulsion.

BACKGROUND OF THE INVENTION

In recent years, there have been the increasing demands, in the market, for a silver halide photographic light sensitive material having a high photosensitive speed and an excellent graininess. In response thereto, the silver halide crystals applied to light sensitive materials have been controlled more precisely and complicatedly.

From the viewpoints of photosensitive speeds, graininess, developability and so forth, the so-called core/shell type grains have widely been used previously, in which the halide compositions have been changed between the inside of silver halide grains and the outside thereof, such as those disclosed in Japanese Patent Publication Open to Public Inspection (hereinafter abbreviated to JP OPI Publication) Nos. 57-15432/1982, 60-143331/1985, 60-138538/1985, 58-9137/1983, 58-9573/1983, 59-48755/1984 and so forth.

Because these emulsions have such a theoretical problem as mentioned hereunder in the processes of forming the grains thereof, it has therefore been found that there are some limitations, from the viewpoints of improving the emulsion characteristics (including, particularly, a photosensitive speed, graininess and fogginess). To be more concrete, in the conventional grain-forming processes, silver ions and halide ions, necessary for forming grains, are each supplied in the forms of an aqueous silver salt solution and an aqueous halide solution into a mixer or a reaction chamber, respectively. Therefore, the excessively concentration distributions of the aqueous solutions may be produced around an adding nozzle and a mixing propeller. The presence of a region having such an ununiform concentration as mentioned above may lead to a rapid growth of silver halide grains passing through the region. Resultingly, reduced silver may be produced and the microscopic unevenness of the halide compositions may also be produced in the grain-forming processes.

As for the already known methods for fundamentally overcoming the problems retaining unsolved in the conventional processes for forming silver halide grains, there include the methods such as disclosed in, for example, W/O 89/06830 or JP OPI Publication No. 2-166442/1990, wherein grains are formed by adding finely sized silver halide grains (hereinafter sometimes referred to as silver halide fine grains or simply to as fine grains) and then by ripening them.

The above-mentioned method is characterized in that silver halide fine grains are used as the supply sources of silver ions and halogen ions. This method is also regarded as the method for forming grains, in which such a problem as mentioned above cannot be raised theoretically, because the ions are released continuously when the fine grains are dissolved after adding and dispersing them into a reaction chamber and because the ion concentration inside the reaction chamber is uniformed by the tremendous numbers of the fine grains.

In the grain-forming methods in which the above-mentioned fine grains are added, the groups of the methods each consisting of a method for forming the fine grains themselves and another method for adding the fine grains thereafter may be roughly classified at present into the following two known methods.

(a) One method in which an aqueous silver salt solution and an aqueous halide solution are reacted each other in a mixing chamber separated from a reaction chamber for forming grains, so that silver halide fine grains having a desired halide composition can be formed, and the resulting silver halide fine grains are immediately added into the reaction chamber.

(b) The other method in which separate from a grain-growth process, silver halide fine grains having a desired halide composition are prepared in advance and the resulting fine grains are added when the grains are grown.

The expression, 'a desired halide composition', stated in each of the above paragraphs (a) and (b) means the same as the halide composition of an objective phase made present inside the silver halide grains to be formed. The above-defined meaning is regarded to be preferable.

The silver halide emulsions prepared each by following the above-mentioned methods and the other silver halide emulsion prepared in the conventional methods (such as a double-jet method in which an aqueous silver salt solution and an aqueous halide solution are used) are each compared and evaluated on the photographic characteristics thereof. However, it was resultingly proved that almost no advantageous effect could be achieved particularly concerning the reduction of fog production (or a reduced silver production) and the improvements of graininess, although the methods are regarded as the grain-forming methods capable of theoretically solving the aforementioned problems.

As for the methods for forming silver halide grains in the presence of an oxidizer, there are known techniques disclosed in for example, JP OPI Publication Nos. 61-3136/1986, 62-54249/1987, 62-73251/1987, 3-172836/1991, 3-189641/1991 and 3-196138/1991. The objects of these techniques are to oxidize reduced silver (or metallic silver) produced chiefly when forming grains so that a fog production can be inhibited. However, even when applying these techniques, it was proved that any satisfactory effects could not be achieved on the fog reduction and the improvements of graininess corresponding to the fog reduction.

SUMMARY OF THE INVENTION

It is accordingly an object of the invention to provide a silver halide emulsion having a low fog, an excellent graininess and a high photosensitive speed.

Another object of the invention is to provide a silver halide photographic light sensitive material applied with the above-mentioned emulsion and excellent in various photographic characteristics.

After the inventors of this invention energetically studied, they achieved the objects of the invention with both of a silver halide emulsion and a silver halide photographic light sensitive material, each having the following characteristics.

(1) A silver halide emulsion comprising a dispersion medium and light-sensitive silver halide grains, wherein a part of or the whole of the silver halide grain forming process is carried out, in the presence of an oxidizing agent, by supplying an emulsion comprising finely sized silver halide grains each formed in the presence of an aqueous protective colloid solution.

(2) A silver halide emulsion comprising a dispersion medium and light-sensitive silver halide grains, wherein a part of or the whole of the silver halide grain forming process is carried out by supplying an emulsion comprising finely sized silver halide grains each formed in the presence of the oxidizing agent and the aqueous protective colloid solution.

(3) A silver halide photographic light sensitive material comprising a support bearing thereon silver halide emulsion layer(s), wherein at least one of the emulsion layers contains the silver halide emulsion described in the above-mentioned (1) or (2).

Description of the reference numerals

1 reactor vessel

10 reaction chamber

11 pH monitor

12 rotary propeller

4,5,6,8,13,14 Adding systems

15 pump

7,26 mixer vessel

9 adjustment vessel

20 addition vessel

21,B aqueous silver nitrate solution

22,C aqueous halide solution

23,aqueous protective colloid solution

24 aqueous oxidizing agent solution

25 flow-rate controller

DETAILED DESCRIPTION OF THE INVENTION

Figure 1:
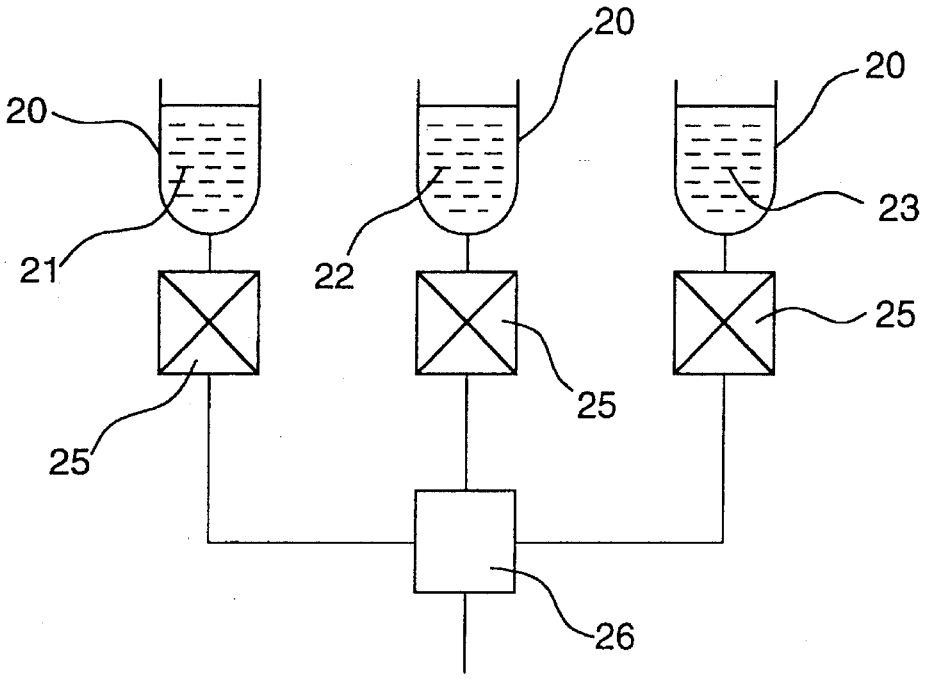
FIG. 1 is a flow diagram showing an embodiment for preparing silver halide fine grains applicable to the invention.

This invention will be detailed as follows.

According to the above-mentioned constitution, the silver halide emulsion of the invention is excellent in photosensitive speed and graininess and low in fog. However, the reasons thereof have still remained in uncertainty. On the other hand, the following facts were confirmed by the results of the various studies made by the present inventors.

In a silver halide emulsion prepared by the method for forming grains in which the aforementioned silver halide fine grains are formed and then added, the photographic characteristics of a silver halide emulsion, including particularly the fog and graininess thereof, are subject to the great influence of the conditions of preparing the silver halide fine grain emulsion to be added.

For example, the fog is deteriorated (or increased) when silver halide grains are formed by making use of silver halide fine grains prepared under the circumstances where a fog is liable to be produced. This fact may supposedly suggest that reduced silver contained in fine grains is made present in the form of fine and minute silver clusters even after the fine grains are dissolved, and the silver clusters are taken in when growing the grains, so that the silver clusters may become fog nuclei. In the aforementioned method, it means that the process capable of producing a fog (or reduced silver) is simply changed from a grain growing process to a fine grain forming process. Therefore, the fundamental problems have not yet been solved.

It can be considered that in the invention, the above-mentioned fog production can be reduced, because fine and minute reduced silver, that is contained in fine grains to be discharged when the grains are dissolved, is oxidized (or ionized) by having an oxidizing agent present in a grain-forming process carried out by adding silver halide fine grains. As compared to the grains formed, in a conventional technique, by simply making an oxidizing agent present therein for inhibiting any fog from producing, the present inventors presume that the reasons why the silver halide grains of the invention can display the remarkable effects are due to the difference in the morphology of reduced silver and that the following reasons are derived therefrom.

1. In the silver halide grains formed in the conventional methods, reduced silver subject to the reaction of an oxidizing agent is one produced on the surfaces of grains being grown. In the cases of the invention, in contrast to the above, the reduced silver is in the form of the so-called silver clusters suspended inside a reaction chamber, which are discharged when fine grains are dissolved.

2. Fine and minute silver clusters are usually unstable. In the cases where silver clusters are made present on the crystal surfaces and made present independently, they are more unstable and liable to be oxidized in the latter case.

3. Reduced silver formed on the surfaces of grains in a grain growing step is buried in the grains when the grains are further being grown up. Therefore, the time for making a reaction with an oxidizing agent is very short. In contrast to the above, silver clusters each suspending in a reaction chamber after they are discharged by dissolving fine grains are capable of reacting with an oxidizing agent until they are taken in the growing grains. Therefore, the possibility of reacting with the oxidizing agent can be extremely higher.

Silver halide grains are usually formed by adding both an aqueous silver salt solution and an aqueous halide solution into an aqueous solution having a protective colloidal property efficient in silver halide grains and then by reacting together.

When forming the grains, the silver halide grains are so formed first as to be the nuclei (or the seeds) for growing the grains and then an aqueous silver salt solution and an aqueous halide solution are each added under the conditions for not producing any new nuclei so that the nuclear grains may be grown up. Thereby, silver halide grains having a narrow grain size distribution can be prepared. The nuclear grains may also be formed in the other process separate from the process for growing grains.

There is also another known method for growing crystals in which grains having a larger grain size and grains having a smaller grain size are made present together and the crystals are grown based on the phenomenon of dissolving the smaller sized grains and growing the larger sized grains (that is called an Ostwald ripening treatment). The methods for preparing silver halide grains are described in, for example, "The Bases of Photographic Engineering—A Volume of Silver Salt Photography", (editted by The Photographic Society of Japan, Corona Co.)

The expression, "a process of forming silver halide grains", stated in the invention means a process in which silver ions and halogen ions (such as the ions in the forms of an aqueous silver salt solution and an aqueous halide solution) or such a supply source as mentioned above for supplying silver ions and halogen ions (such as the sources comprising silver halide fine grains) are each added so as to grow the grains.

The term, "a dispersion medium", stated in the invention means gelatin, natural high molecular compounds other than gelatin, synthetic high molecular compounds or the aqueous solutions thereof, and each of the media has a protective colloidal property efficient in silver halide grains. These dispersion media may be referred to the following literatures; the above-mentioned "The Bases of Photographic Engineering—A Volume of Silver Salt Photography"; "The Behavior of Hydrophilic Polymers as Protective Colloids for Silver Halides (Report Nos. 1 through 3)", (The Bulletin Issued by The Photographic Society, Vol. 29, No. 1 & Vol. 30, No. 1); and so forth.

The expression, "finely sized silver halide grains formed in the presence of a dispersion medium", herein means silver halide fine grains formed by making use of a mother liquor containing a dispersion medium or an adding solution containing a dispersion medium (such as an aqueous silver salt solution containing a dispersion medium, an aqueous halide solution and an aqueous dispersion medium solution). The term, "a mother liquor" herein means a liquid made present in advance in a reaction chamber for forming silver halide grains by adding thereto either an aqueous silver salt solution or an aqueous halide solution.

The expression, "an emulsion comprising finely sized silver halide grains is supplied in the presence of an oxidizing agent", herein concretely means, for example, the case where a fine grain emulsion is supplied into an emulsion solution containing an oxidizing agent in advance, another case where a silver halide fine grain emulsion and an oxidizing agent are supplied at the same time but separately, or a further case where a fine grain emulsion containing an oxidizing agent is supplied.

The expression, "a finely sized silver halide grains formed in the presence of an oxidizing agent", herein means silver halide fine grains formed by making use of a mother liquor containing the oxidizing agent or an adding solution containing the oxidizing agent (such as an aqueous silver salt solution, an aqueous halide solution and an aqueous solution prepared by adding the oxidizing agent to an aqueous protective colloidal solution).

The silver halide grains of the invention can be formed by a method of supplying silver halide fine grains in the presence of an oxidizing agent, in a part or the whole grain-forming process. The silver halide fine grains supplied thereto are dissolved in a reaction chamber to serve as the sources for supplying silver ions and halogen ions each necessary to form the grains.

In the invention, the partial volume formed by supplying silver halide fine grains in the presence of an oxidizing agent accounts for preferably not less than 3% of the total volume of the silver halide grain after completing the growth thereof, further preferably not less than 10% thereof, still further preferably not less than 30% thereof and particularly not less than 60% thereof. It is most preferable that the whole silver halide grain is formed by supplying silver halide fine grains. The phases formed by supplying silver halide fine grains such as mentioned above are preferable to be located outside the grain, because the more the effects of the invention can be remarkable, the more the proportion of the phase formed by supplying fine grains in the presence of an oxidizing agent is increased, or the more the phase thereof is located further outside the grains.

The methods for forming grains by supplying finely sized silver halide grains each applicable thereto include, for example, a method in which silver halide grains only are substantially supplied, another method in which the supply of an aqueous silver salt or a halide solution is accompanied, such as described in JP OPI Publication No. 2-167537/1990. As for the methods of supplying substantially silver halide grains only, it is allowed to use a method for making use of fine grains having the same composition as the halide composition to be used when objective grains are formed, or another method in which two or more kinds of silver halide fine grains each having the different halide compositions are supplied at the same time in any proportions so that an objective halide composition can be obtained, such as described in JP Application No. 3-218608/1991.

When preparing a silver halide emulsion of the invention, the silver halide fine grains applicable thereto may be prepared either in advance of or in parallel with the preparation of the silver halide emulsion. When preparing them in parallel with each other, that is, in the latter case, the methods for forming fine silver halide grains are disclosed, such as those disclosed in JP OPI Publication Nos. 1-183417/1989 and 2-44335/1990, in which the silver halide fine grains are prepared by means of a mixer vessel provided separately to the outside of a reactor vessel so that the fine grains can be formed. In the practical systems, however, 1. The supply rates of an aqueous silver salt solution and an aqueous halide solution to the mixer vessel are subject to the influence of the growth rate of silver halide grains contained in the reactor vessel; and
2. The circumstances (such as the pAg, pH and temperatures) under which silver halide fine grains are formed and those under which silver halide grains are formed in the reactor under which vessel are not independent of each other.

To be more concrete, as described in JP Application No. 2-314891/1990, it is preferable, concerning to the pAg, pH and temperature in the reactor vessel, to provide an adjustment vessel after completing the fine grain formation and to supply a silver halide fine grain emulsion to the reaction chamber while adjusting the fine grain emulsion to meet the emulsion grain growing circumstances in the reaction chamber.

Figure 3:
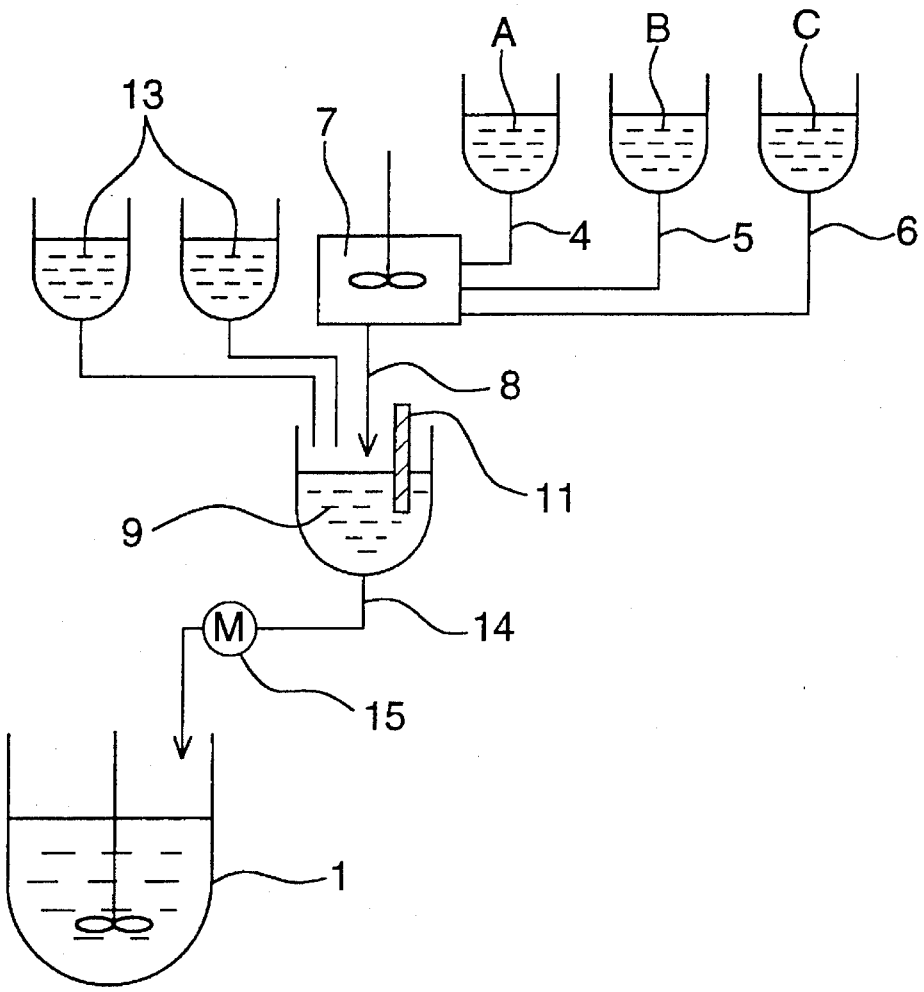
FIG. 3 is a diagram illustrating equipment for forming silver halide fine grains applicable to the invention.

An embodiment of the equipment for forming the silver halide fine grains relating to the invention will be exemplified in FIG. 3 attached hereto.

The methods for forming the above-mentioned silver halide grains applicable thereto include, for example, a method in which grains are formed by making use of nitric acid or the like in the acidic to weakly acidic circumstances (at a pH≦5.6), another method in which grains are formed in the weakly acidic or neutral circumstances (at a pH of 5.5≦ pH≦7), and a further method in which grains. are formed by making use of a silver halide solvent such as ammonia. However, the grains are formed preferably in the acidic or neutral circumstances and further preferably in the acidic to weakly acidic circumstances.

A pAg is to be preferably not lower than 3.0, further preferably not lower than 5.0 and particularly not lower than 8.0, because when a silver ion concentration is high, the reduced silver nuclei of the fine grains themselves are liable to be produced in the subject circumstances.

The temperatures in the forming process of the silver halide fine grains are to be suitably not higher than 50° C., preferably not higher than 40° C. and further preferably not higher than 35° C. When silver halide grains are formed in this method, any common types of high molecular gelatin may be used as the protective colloids including typically those given in Research Disclosure, Paragraph IX, Vol. 176, No. 17643, December, 1978.

Besides the above, an emulsion can also be prepared at a low temperature. In this case, an Ostwald ripening may be inhibited after the fine grain form. However, gelatin is liable to coagulate when forming grains at a low temperature. If this is the case, it is also allowed to use a low molecular weight gelatin, a synthetic high molecular compound having a protective colloidal property efficient in silver halide grains, or a natural high molecular compound other than gelatin. These compounds are described in, for example, JP OPI Publication No. 2-166442/1990. The concentration of the protective colloids may be not less than 1 wt %, suitably not less than 2 wt % and more suitably not less than 3 wt %.

After the above-mentioned silver halide fine grains are formed, they are added into a reactor vessel containing nucleus grains (or seed grains), so that the silver halide grains may be grown up with the aid of an Ostwald ripening effect. The silver halide fine grains formed in the invention can readily be dissolved, because their grain sizes are fine and minute, and they are dissolved into silver ions and halide ions again to accomplish uniformly growth of the silver halide grains. The resulting fine grains may have either of the single or plural halide composition, so that the objective silver halide grains can be formed. It is also allowed that a plurality of fine grains each having a single halogen composition are formed and then added upon controlling their flow rates, so that a phase having an objective halogen composition may be formed.

The grain sizes of the fine grains applicable to the invention are to be not larger than 0.05 μm, preferably not larger than 0.03 μm and more preferably not larger than 0.01 μm. When making use of the equipment shown in FIG. 3 and an overall time from forming fine grains in a mixer vessel 7, through the transfer the resulting grains to adjustment vessel 9, to the supply thereof to reactor vessel (or a grain growing tank) 1 is preferably not longer than 7 hours, more preferably not longer than 2 hours and further preferably not longer than 20 minutes.

As mentioned before, the adjustment vessel 9 is preferably provided with a thermostat for keeping an emulsion at a given temperature. The temperature for preparing the emulsion is preferable to be not higher than 50° C., more preferably not higher than 40° C. and further more preferably not higher than 35° C., as same as in the case of forming the fine emulsion grains.

To be detailed further of FIG. 3, chambers A, B, C contain each an aqueous protective colloid solution, an aqueous silver nitrate solution and an aqueous halide solution, respectively. These solutions are supplied to mixer vessel 7 through solution adding systems 4,5,6, while the adding flow rates of the solutions are being controlled, respectively. The solutions are rapidly and forcibly mixed up in mixer 7 and are then discharged therefrom so that the mixed solution can supplied to the following adjustment vessel 9 through system 8.

Figure 4:
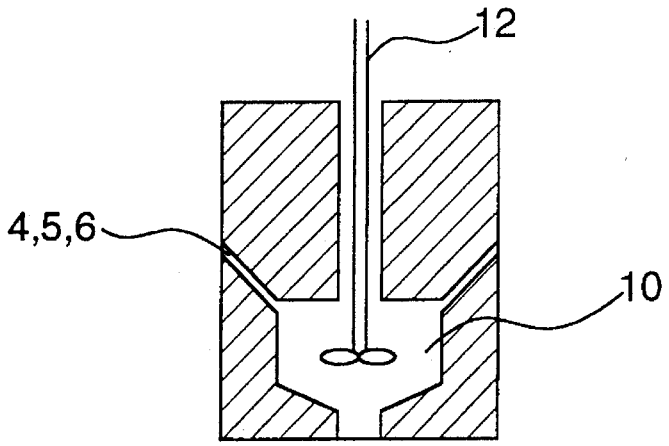
FIG. 4 is a cross-sectional view showing a mixer applicable to the invention.

FIG. 4 shows the details of mixer vessel 7. Mixer vessel 7 is provided inside thereof with reaction chamber 10 into which rotary propeller 12 is provided so that the solutions can be mixed up thereby rapidly and forcibly. The rotation speed of the rotary propeller is to be not slower than 5,000 rpm, preferably not slower than 7,000 rpm and further preferably not slower than 10,000 rpm. To adjustment vessel 9, monitor 11 for monitoring pAg and pH is provided, and the conditions can be kept constant by a control solution and the control solution adding system (for the control solution).

A fine grain emulsion is supplied into reactor vessel 1 (or a grain growing tank) for growing crystals, through the equipments such as adding system 14 and, for example, pump 15.

An oxidizing agent is preferable to be made present when grains are grown by supplying fine grains. It is further preferable that the fine grains to be supplied are formed in the presence of the oxidizing agent. This is because the effects of the invention can become more remarkable, for example, by making use of an oxidizing agent, when forming fine grains, in the same amount as the amount of an oxidizing agent made present when grains are formed by supplying fine grains.

The term, "an oxidizing agent", stated in the invention means those capable of oxidizing and ionizing the silver clusters produced during the course of forming silver halide grains. The resulting silver ions may produce either a hardly soluble silver salt such as silver halide, or a silver salt having a high solubility to water.

The oxidizing agents applicable to the invention may be inorganic or organic oxidizing agents. The inorganic oxidizing agents include, for example, ozone, hydrogen peroxide and the adducts thereof, oxyacid salts such as peroxoacid salt, halogens such as iodine and bromine, and thiosulfonates. The organic oxidizing agents include, for example, quinones such as p-quinone, and organic peroxides.

Among the above-given oxidizing agents, those preferably applicable to the invention include, for example, a halogens element and, particularly, iodine.

In the invention, such an oxidizing agent as mentioned above may be added in an amount within the range of, preferably not less than $10^{-8}$ mols to not more than $10^{-1}$ mols, more preferably not less than $10^{-7}$ mols to not more than $10^{-2}$ mols and, particularly not less than $10^{-5}$ mols to not more than $10^{-2}$ mols, each per mol of silver halide used.

To the invention, for the methods for making an oxidizing agent present during forming grains, any common methods for making an additive present therein may be applied. For example, an oxidizing agent may be made present in advance in a mother liquor (usually including a dispersion medium) in which silver halide grains are formed, or the oxidizing agent may also be added in the course of forming grains. When it is added during the formation of grains, it may be added at a time or may also be added upon dividing it into two or more parts. It is further allowed to add it at a constant rate by making use of a pump, or to add it extending over a long time while controlling the rate of the addition.

When making an oxidizing agent present during the formation of silver halide fine grains, the same methods as mentioned above may also be applied. As shown in FIG. 1, for example, when preparing fine grains in parallel with a grain growing process, an oxidizing agent may be made present in each of vessels 20 for adding protective colloid solution 23 and for adding aqueous halide solution 22, respectively.

Figure 2:
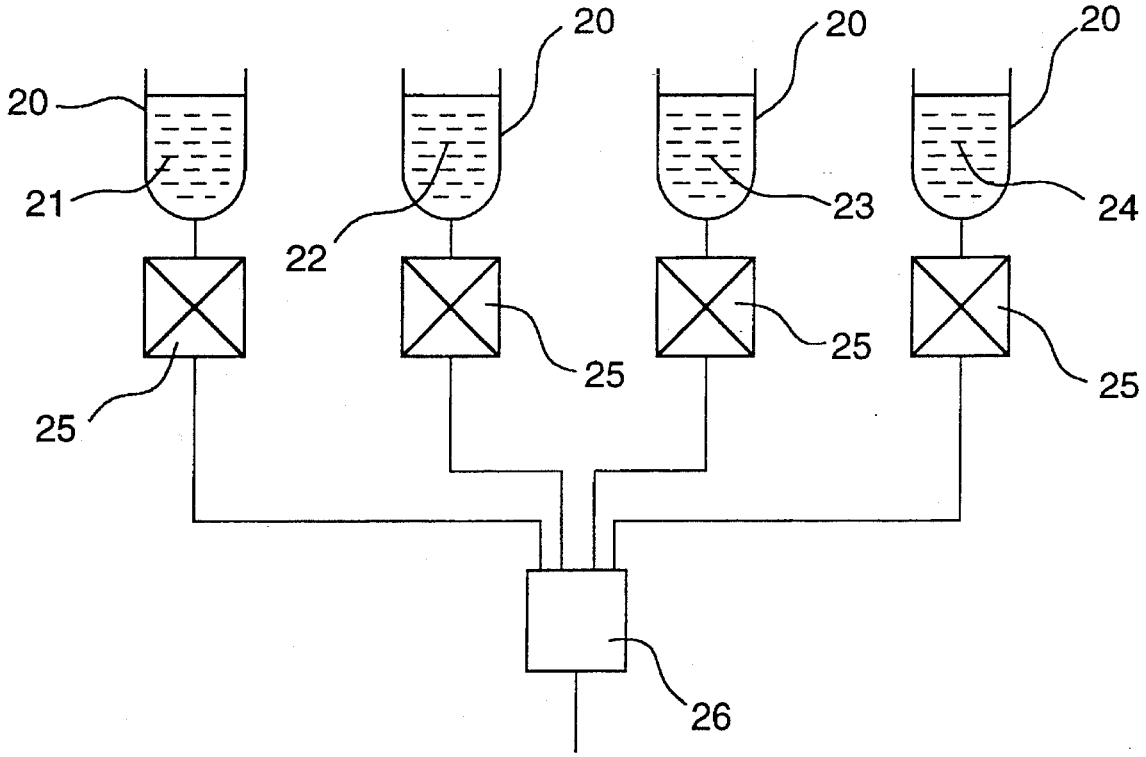
FIG. 2 is a flow diagram showing another embodiment for preparing silver halide fine grains applicable to the invention.

As shown in FIG. 2, it is also allowed to provide vessel 20 for containing an oxidizing agent solution 24 and to add it therefrom, during the formation of fine grains.

The oxidizing agents applicable thereto may be used after they are prepared in any procedures at will, provided that the effects of the oxidizing agents cannot be spoiled. To be more concrete, the compounds hardly soluble or insoluble to water are dissolved in advance to a suitable solvent such as alcohols, ketones or glycols and are then added. The water-soluble compounds may be added in the form of the aqueous solution thereof. When making use of a halogen and, particularly, when making use of iodine, it is preferable to dissolve it in alcohols in advance and then to use the resulting solution thereof.

In the silver halide emulsions of the invention, there is no special limitation to the silver halide compositions thereof. However, in the case of silver iodobromide grains, it is preferable to have a core/shell structure of the internally high iodide containing type, from the viewpoints of photosensitive speed and graininess. In this case, the silver iodide content of the core phase thereof is preferably not less than 15 mol % and, further preferably not less than 20 mol %. The silver iodide content of the outermost shell phase thereof is preferably not more than 10 mol % and, further preferably not more than 5 mol %. As for the methods for analyzing the compositions of the silver halide grains such as mentioned above, the method described in, for example, JP Application No. 2-265842/1990 may be referred.

In the emulsions of the invention, the silver iodide contents thereof among the grains are preferable to be uniform. When the average silver iodide content of individual silver halide grains is measured in an XMA method, it is preferable that the relative standard deviation of the measured value is preferable to be not more than 20%, further not more than 15% and, particularly not more than 12%.

The term, "a relative standard deviation", stated herein can be obtained by the following method. For example, when measuring the silver iodide contents of at least 100 grains, the resulting standard deviation of the silver halide contents is divided by the resulting average silver iodide content obtained therefrom, and the resulting quotinent×100 can be defined as the relative standard deviation.

In the silver halide grains of the invention, there is no special limitation to the crystal habits thereof.

The silver halide grains of the invention may be of the regular crystal forms such as cubes, octahedrons, dodecahedrons, tetradecahedrons and trisoctahedrons, of the twinned crystal forms such as the tabular-shaped or other shaped, of the amorphous shaped such as the potato-shaped amorphous, and of the mixtures thereof.

In the case where the twinned crystals are of the tabular-shaped and when the projective area of a grain is converted into the area of a circle having the same area as the above-mentioned projective area, among the tabular-shaped twinned crystal grains, those having the ratios of the diameter of the circle (circular-equivalent diameter) to the grain thickness of 1 to 20 account for preferably not less than 60% of the projective area and, further, the above-mentioned ratios are to be within the range of, further preferably not less than 1.2 to less than 8.0 and, particularly not less than 1.5 to less than 5.0.

It is preferable that the silver halide emulsions of the invention are monodisperse type silver halide emulsions.

In the invention, "a monodisperse type silver halide emulsions" is defined as that the silver halide grains thereof having a grain size within the range of ±20% of an average grain size d are contained therein in an amount by weight of not less than 70%, preferably not less than 80% and, particularly not less than 90% of the whole amount by weight of the total silver halide grains of the emulsion.

The term, "an average grain size", stated herein is defined as a grain size di obtained when a product, $n_i \times d_i^3$, is maximized, in which $n_i$ is a frequency of the grains each having grain size $d_i$. (In the figures, the significant figures have three places and the minimum figure is rounded to the nearest whole number.)

The term, "a grain size", stated herein means the diameter of a circle obtained by converting the projective image of a grain into a circular image having the same area as that of the grain.

The above-defined grain size can be measured in the following procedures. For example, a grain is magnified and projected 10,000 to 50,000 times larger through an electron microscope, and the diameter or projected area of the grain came out on the resulting print is then measured, (provided that the number of the grains subject to the measurement is to be not less than 1,000 grains at random.)

The particularly preferable high-monodisperse type emulsions of the invention have the distribution range (defined as follows) of not wider than 20% and, preferably not wider than 15%.

$$(\text{Standard grain deviation}/\text{Average grain size})\times 100=\text{Distribution range } (\%)$$

The grain size measurement method used herein is according to the aforementioned measurement method, and the average grain size is expressed in terms of arithmetical mean.

$$\text{Average grain size}=\Sigma d_i n_i/\Sigma n_i$$

In the silver halide emulsions of the invention, the average grain size thereof is within the range of, preferably, 0.1 μm to 10.0 μm, further 0.2 μm to 5.0 μm and, particularly 0.3 μm to 3.0 μm.

When constituting the emulsions of the invention or the light sensitive materials prepared by making use of the emulsions of the invention (hereinafter sometimes referred to the light sensitive materials of the invention) and when preparing some other emulsion used in combination if required, that is other than the emulsions of the invention (including when preparing the seed emulsions), there may be added a substance having an adsorbing property to silver halide grains, that is other than gelatin. The useful adsorbable substances include, for example, the compounds applicable to the skilled in the art as a sensitizing dye, an antifoggant or a stabilizer or heavy-metal ions. The concrete examples of the above-mentioned adsorbable substances are given in, for example, JP OPI Publication No. 62-7040/1987.

For the purpose of reducing a fog production from an emulsion and improving the aging stability of the emulsion, it is preferable to add at least one kind of the antifoggants or stabilizers selected from the above-mentioned adsorbable substances, when preparing a seed emulsion.

Among the antifoggants and stabilizers, a heterocyclic mercapto compound and/or an azaindene compound are particularly preferable. The concrete examples thereof preferably applicable are detailed in, for example, JP OPI Publication No. 63-41848/1988.

The above-mentioned heterocyclic compounds and/or azaindene compounds may be added in any amounts without limitation. However, they may be added in an amount within the range of, preferably, $1\times10^{-5}$ to $3\times10^{-2}$ mols and, particularly $5\times10^{-5}$ to $3\times10^{-3}$ mols, each per mol of silver halide used therein. The above-mentioned amounts used therein may be suitably selected to meet the conditions of preparing silver halide grains, the average grain size of silver halide grains and the kinds of the above-mentioned compounds.

A finished emulsion completely satisfying the prescribed grain requirements can be desalted in a known method, after forming the silver halide grains thereof. As for the desalting methods, it is also allowed to use the gelatin coagulants described in, for example, JP OPI Publication Nos. 63-243936/1988 and 1-185549/1989, or to use a noodle-washing method in which a desalting treatment is carried out by gelling gelatin. It is further allowed to use a coagulation method making use of an inorganic salt comprising polyvalent anion (such as sodium sulfide), an anionic surfactant, and an anionic polymer (such as polystyrenesulfonic acid). Generally, the silver halide emulsion desalted as described above are redispersed in gelatin so that the emulsions can be prepared.

As for the silver halide grains of the light sensitive materials of the invention, not only the silver halide grains of the invention, but also any other silver halide grains can be used in combination.

It is allowed to make any combination use of silver halide grains even if they have any grain size distributions. It is also allowed to make use of an emulsion having a wide grain size distribution (hereinafter referred to as a polydisperse type emulsion) or a monodisperse type emulsion having a narrow grain size distribution.

The light sensitive material of the invention can be prepared by containing the silver halide grains of the invention in at least any one of the silver halide emulsion layers constituting the light sensitive material. It is, however, allowed that the same layer also contains any other silver halide grains than those of the invention.

In this case, the emulsion containing the silver halide grains of the invention accounts for not less than 20% by weight preferably and not less than 40% by weight further preferably.

When a light sensitive material of the invention comprises two or more silver halide emulsion layers, it is also allowed to make present an emulsion layer consisting of any other silver halide grains only than the silver halide grains applicable to the invention.

In this case, the emulsions of the invention are to accounts, preferably, not less than 10% by weight of the silver halide emulsions applied to the whole light sensitive layer constituting a light sensitive material and, more preferably, not less than 20% by weight.

The silver halide grains of the invention can be spectrally sensitized by making use of the spectral sensitizers given in the following volumes and pages of Research Disclosure (hereinafter abbreviated to RD), or they can spectrally be sensitized by making combination use of other sensitizers.

No. 17643 (pp. 23~24),

No. 18716 (pp. 648~649) and

No. 308119 (p. 996, IV-A,B,C,D: H,I,J)

The silver halide grains other than those of the invention, which are also applicable, if required, to the light sensitive materials of the invention, such grains can be sensitized optically to any wavelength regions.

In such a case as mentioned above, there is no special limitation to the optical sensitization methods. An optical sensitization can be performed by making independent or combination use of optical sensitizers including, for example, cyanine dyes or merocyanine dyes, such as zeromethine dye, monomethine dye, dimethine dye and trimethine dye. The sensitizing dyes are often used in combination, particularly for making a supersensitization. It is also allowed that an emulsion contains a dye having any spectral sensitizing functions in itself, that is a substance substantially incapable of absorbing any visible rays of light, but capable of displaying a supersensitizing effect.

The above-described techniques are also detailed in U.S. Pat. Nos. 2,688,545, 2,912,329, 3,397,060, 3,615,635 and 3,628,964, British Patent Nos. 1,195,302, 1,242,588 and 1,293,862, West German (OLS) Patent Nos. 2,030,326 and 2,121,780, JP Examined Publication No. 43-14030/1968, RD 17643, Vol. 176, p.23, IV-J, December, 1978, and so forth. Any one of the techniques can be selected to meet an objective wavelength region and/or sensitivity each to be sensitized, and the purposes and application of an objective light sensitive material.

In the invention, a variety of any commonly applicable chemical sensitization treatments can be applied. The chalcogen sensitizers applicable to chemical sensitization treatments include, for example, a sulfur sensitizer, a selenium sensitizer and a tellurium sensitizer. For the photographic use, the sulfur or selenium sensitizers are preferred. For the sulfur sensitizers, any known ones can be used, such as thiosulfate, allylthiocarbamide, thiourea, allylisothiocyanate, cystine, p-toluene thiosulfonate and rhodanine.

Besides the above, it is also allowed to use the sulfur sensitizers given in, for example, U.S. Pat. Nos. 1,574,944, 2,410,689, 2,278,947, 2,728,668, 3,501,313 and 3,656,955, West German (OLS) Patent No. 1,422,869, and JP OPI Publication Nos. 56-24937/1981 and 55-45016/1980. Such a sulfur sensitizer as mentioned above may be used in an amount enough to effectively enhance the sensitivity of an objective emulsion. The suitable amounts thereof may be varied extending considerably over a wide range under the various conditions of pH values, temperatures and the grain sizes of silver halide grains. However, the amounts thereof are preferably within the range of the order of about $10^{-7}$ mols to about $10^{-1}$ mols per mol of silver halide used therein, as a standard.

The selenium sensitizers applicable thereto include, for example, aliphatic isoselenocyanates such as allyl isoselenocyanate, selenoureas, selenoketones, selenoamides, selenocarboxylic acids and the esters thereof, selenophosphates and selenides such as diethyl selenide and diethyl diselenide. The concrete examples thereof are given in, for example, U.S. Pat. Nos. 1,574,944, 1,602,592 and 1,623,499.

The amounts added thereof are varied extending over a wide range, similar to the case of the sulfur sensitizers. However, the amounts thereof are preferably within the range of the order of about $10^{-7}$ mols to about $10^{-1}$ mols per mol of silver halide used therein, as a standard.

In the invention, the gold sensitizers applicable thereto may have either +1 valency or of ∓valency. Therefore, a variety of gold compounds are used therein. The typical examples thereof include chloroauric acid, potassium chloroaurate, auric trichloride, potassium auric thiocyanate, potassium iodoaurate, tetracyanoauric acid, ammonium aurothiocyanate and pyridyl trichlorogold.

The amounts of the gold sensitizers added thereto may be varied according to the various conditions. However, it is preferable to be within the range of about $10^{-7}$ mols to about $10^{-1}$ mols per mol of silver halide used therein, as a standard.

The points of time for adding a gold sensitizer may be at the same time when a sulfur or selenium sensitizer is added, while carrying out a sulfur or selenium sensitization treatment or after completing the sensitization treatment.

In the invention, an emulsion subject to a sulfur or selenium sensitization and a gold sensitization is preferable to have a pAg and a pH within the ranges of 5.0 to 10.0 for the former and 5.0 to 9.0 for the latter, respectively.

In the invention, the chemical sensitization treatments can be carried out in combination with other sensitization treatments applied with a metal salt or the complex salts of noble metals such as platinum, palladium, iridium and rhodium.

Further, for the compounds capable of releasing gold ions from gold-gelatinate and accelerating adsorption of gold ions to silver halide grains, the complexes of Rh, Pd, Ir, Pt and so forth are effective.

The concrete examples of the above-mentioned compounds include $(NH_4)_2[PtCl_4]$, $(NH_4)_2[PdCl_4]$, $K_3[IrBr_6]$, $[RhCl_6]_{12}H_2O$ and so forth. Among them, ammonium tetrachloropalladate (II), $[NH_4)_2[PdCl_4]$ is particularly preferable. These compounds may be added preferably in an amount within the range of 10 to 100 times as much as the amount of a gold sensitizer in terms of a stoichiometric ratio (or a mol ratio).

These compounds may be added in any steps of starting, progressing and completing a chemical sensitization treatment. Inter alia, they may be added preferably in the step of progressing the chemical sensitization treatment and, particularly, they may be added either at the same time when a gold sensitizer is added or before or after the gold sensitizer is added.

Further when carrying out a chemical sensitization treatment, it is allowed to make present a compound having a nitrogen-containing heterocyclic ring or, preferably, an azaindene ring in particular.

The amounts of the above-mentioned nitrogen-containing compounds may be varied in the wide ranges according to the sizes, compositions and chemical sensitizing conditions of the emulsion grains used. It is, however, preferable to add them in an amount of the order capable of forming a layer containing 1 to 10 molecules over each of the silver halide grain surfaces. The amounts thereof may be added in the same amounts added when treating the sensitization. The amounts thereof can also be increased or reduced in an adsorption equibrium state controlled by adjusting the pH and/or temperature when treating the sensitization. It is further allowed that two or more kinds of the above-mentioned compounds can be added in combination into an emulsion, provided the whole amount of the compounds can be within the above-mentioned range.

The methods for adding the above-mentioned compounds into an emulsion can be performed by dissolving the compounds into a suitable solvent (such as water and an aqueous alkali solution) incapable of affecting any photographic emulsions and then by adding the resulting solution to the emulsion. The compounds may be added preferably before or at the same time when a sulfur- or selenium-sensitizer is so added as to chemically sensitize an emulsion. The above-mentioned gold sensitizer may be added when progressing or completing the sulfur- or selenium-sensitization treatment.

It is, further, allowed that the above-mentioned silver halide grains can be optically sensitized to any wavelength regions at will by making use of a sensitizing dye.

When embodying the invention, a variety of additives can be applied to any light sensitive materials. For example, the following Research Disclosure (R.D.) exemplify the photographic additives applicable thereto. The following table shows the exemplifications thereof and the corresponding places thereof.

| [Item] | Page & section of RD308119 | Page of RD17643 | Page of RD18716 |
|---|---|---|---|
| Color contamination preventive | 1002 VII-I | 25 | 650 |

-continued

| [Item] | Page & section of RD308119 | Page of RD17643 | Page of RD18716 |
|---|---|---|---|
| Dye image stabilizer | 1002 VII-J | 25 | |
| Whitening agent | 998 V | 24 | |
| UV absorbent | 1003 VIIIC XIIIC | 25 ~ 26 | |
| Light absorbent | 1003 VIII | 25 ~ 26 | |
| Light scattering agent | 1003 VIII | | |
| Filter dye | 1003 VIII | 25~26 | |
| Binder | 1003 IX | 26 | 651 |
| Antistatic agent | 1006 XIII | 27 | 650 |
| Hardener | 1006 X | 26 | 651 |
| Plasticizer | 1006 XII | 27 | 650 |
| Lubricant | 1006 XII | 27 | 650 |
| Activator.Coating aid | 1005 XI | 26 ~ 27 | 650 |
| Matting agent | 1007 XVI | | |
| Developing agent | 1011 XXB | | |

A variety of couplers can be applied to the invention. The concrete examples of the couplers are exemplified in the above-given RDs. The following table shows the corresponding places thereof.

| [Item] | Page of RD308119 | RD17643 |
|---|---|---|
| Yellow coupler | 1001 VII-D | VII C ~ G |
| Magenta coupler | 1001 VII-D | VII C ~ G |
| Cyan coupler | 1001 VII-D | VII C ~ G |
| Colored coupler | 1002 VII-G | VII G |
| DIR coupler | 1001 VII-F | VII F |
| BAR coupler | 1002 VII-F | |
| Other photographically useful group releasing coupler | 1001 VII-F | |
| Alkali-soluble coupler | 1001 VII-E | |

The additives applicable to the invention can be added in the dispersion method detailed in RD 308119, XIV or the like.

In the invention, it is allowed to use the supports described in the above-given RD 17643, p. 28, RD 18716, pp. 648~648, and RD 308119, XVII.

It is also allowed that the light sensitive materials of the invention can be provided with auxiliary layers such as a filter layer and an intermediate layer, about which the aforegiven RD 308119, VII-K.

In the light sensitive materials of the invention, a variety of layer arrangements can be taken, such as the regular layer arrangement, inversive layer arrangement and a unit layer arrangement, about which the afore-given RD 308119, VII-K.

The invention can be preferably applied to a variety of color light sensitive materials typified by color negative film for general or cinematographic use, color reversal film for slide or TV use, color paper, color positive film, color reversal paper and so forth.

The invention can also be applied to various applications such as black-and-white photography for general use, radiography, infra-red photography, micrography, silver-dye bleaching process, diffusion-transfer process and reversal process.

The light sensitive materials of the invention can be developed in any commonly applicable treatments. The development treatments thereof can be performed in the common processes described in, for example, RD 17643, pp. 28~29, RD 18716, p. 615 and RD 308119, XIX.

EXAMPLES

Now, the following embodiments of the invention will be exemplified so that the invention can be detailed further.

However, the invention shall not be limited to the particular embodiments.

Preparation of Globular-shaped Seed Emulsion EM-T1

In the following procedures, monodisperse type, globular-shaped, seed emulsion EM-T1 was prepared.

| | |
|---|---|
| [A] | |
| Ossein gelatin | 80.0 g |
| Potassium bromide | 47.4 g |
| Add distilled water to make | 800 ml |
| [B] | |
| Silver nitrate | 1,200 g |
| Add distilled water to make | 1,600 ml |
| [C] | |
| Ossein gelatin | 32.2 g |
| Potassium bromide | 823.9 g |
| Potassium iodide | 23.5 g |
| Add distilled water to make | 1,600 ml |
| [D] | |
| Aqueous ammonia | 470 ml |

Solutions [B] and [C] were each added to solution [A] that was violently stirred at 40° C. in a double-jet method by taking 11 minutes, so that the nuclei could be produced. During the course thereof, the pBr was kept at 1.60.

Thereafter, the temperature was lowered to 30° C. by taking 12 minutes and a ripening treatment was then carried out for 18 minutes. Further, solution [D] was added by taking one minute and, successively, a 5 minute-ripening treatment was carried out. The concentration of KBr and ammonia were 0.07 mols/liter and 0.63 mols/liter each during the ripening treatment, respectively.

After completing the ripening treatment, the pH was adjusted to be 6.0 and a desalting treatment was then carried out in an ordinary method.

When observing the resulting seed emulsion grains through an electron microscope, the grains were proved to be the globular-shaped emulsion grains each having two twinned crystal faces parallel with each other and an average grain size of 0.3 μm.

EXAMPLE 1

<Preparation of EM-101 . . . A comparative emulsion>

By making use of the following 5 kinds of solutions and twinned crystal seed emulsion EM-T1, emulsion EM-101 was prepared.

| | |
|---|---|
| (Solution $A_1$) | |
| Ossein gelatin | 268.2 g |
| Distilled water | 4.0 liters |
| Seed emulsion EM-T1 | 0.286 mols |
| An aqueous 10% nitric acid solution | An amount to adjust the pH |
| Add distilled water to make | 5,930.0 ml |
| (Solution $B_1$) | |
| An aqueous 3.5 N silver nitrate solution | 10.31 mols |
| (Solution $C_1$) | |
| An aqueous 3.5 N potassium bromide & potassium iodide solution (containing 2.0 mol % potassium iodide), containing 2.0 wt % gelatin | |
| (Solution $F_1$) | |
| An aqueous 10% silver nitrate solution | |

-continued

| | |
|---|---|
| (Solution $G_1$) | |
| An aqueous 1.75 N potassium bromide solution | |

To Solution $A_1$ stored in a reaction chamber and kept at 65° C., pH 4.00 and pAg 8.06, solutions $B_1$ and $C_1$ were acceleratedly added in a double-jet method, so that the seed crystals were grown up to be 1.0 μm (in the size converted into globes). The adding rates of solutions $B_1$ and $C_1$ were each controlled to be suitable by changing these rates time-functionwise, to meet the critical growth rate, but so as neither to produce any small grains other than the seed crystals being grown nor to polydisperse them in an Ostwald ripening reaction.

In the course of growing the crystals, the pH was controlled to keep at 4.00 by making use of solution $F_1$, and the pAg was continuously changed from 8.2 to 9.0 by making use of solution $G_1$.

After completing the growth of the grains, a desalting treatment was carried out according to the method described in JP Application No. 3-41314/1991. Thereafter, the resulting grains were redispersed by adding gelatin and the pH and pAg thereof were then adjusted to be 5.80 and 8.06, respectively.

When the resulting silver halide grains were observed through a scanning type electron-microscope, they were proved to be the low aspect ratio, twinned crystal and monodisperse type emulsion grains each having a spherically converted average grain size of 1.0 μm, a distribution range of 9.6%, an aspect ratio of 2.3 and two twinned crystal faces parallel with each other.

<Preparation of EM-102 . . . a comparative emulsion>

Emulsion EM-102 was prepared in the same manner as in the case of EM-101, except that, in the stage where solution $B_1$ was added in an amount equivalent to 5.31 mols, a methanol solution containing iodine was added, as an oxidizing agent, in an amount of $2.5\times10^{-4}$ mols, into a reaction chamber.

The resulting silver halide grains were proved to be the low aspect ratio, twinned crystal and monodisperse type emulsion grains each having a spherically converted average grain size of 1.0 μm, a distribution range of 9.6%, an aspect ratio of 2.3 and two twinned crystal faces parallel with each other.

<Preparation of EM-103 . . . a comparative emulsion>

Emulsion EM-103 was prepared in almost the same manner as in the case of EM-101, except that the additions of solutions $B_1$ and $C_1$ were stopped in the stage where solution $B_1$ was added in an amount equivalent to 5.31 mols, and the remaining grains were formed by making use of fine grain emulsion MC-1 in an amount equivalent to 5.0 mols.

From the scanning type electron-microscopic photograph of the resulting emulsion grains, they were proved to be the low aspect ratio, twinned crystal and monodisperse type emulsion grains each having an average grain size of 1.0 μm (that was converted into the spherical grain size), a distribution range of 10.5%, an aspect ratio of 2.3 and two twinned crystal faces parallel with each other.

The procedures for preparing the above-mentioned fine grain emulsion MC-1 will be detailed below.

(Preparation of fine grain emulsion MC-1)

Into 5,000 ml of a 6.0 wt % gelatin solution containing 0.06 mols of potassium bromide, 2,000 ml each of both an aqueous 7.06 mol-silver nitrate solution and an aqueous solution containing 7.06 mol-potassium bromide and potassium iodide (in a ratio of KBr:KI=98:2) were added by taking 10 minutes. In the course of forming the fine grains, the pH and temperature were controlled to be pH 2.0 and 30° C., respectively. After completing the grain formation, the pH was adjusted to be 6.0 by making use of an aqueous sodium carbonate solution.

<Preparation of EM-104 . . . an emulsion relating to the invention>

Emulsion EM-104 was prepared in almost the same manner as in the case of EM-101, except that the additions of solutions $B_1$ and $C_1$ were stopped in the stage where solution $B_1$ was added in an amount equivalent to 5.31 mols, and a methanol solution containing iodine in an amount of $2.5\times10^{-4}$ mols was added, as an oxidizing agent, into a reaction chamber. Successively, the remaining grains were formed by making use of fine grain emulsion MC-1 in an amount equivalent to 5.0 mols.

From the scanning type electron-microscopic photographs of the resulting silver halide grains, they were proved to be the low aspect ratio, twinned crystal and monodisperse type emulsion grains each having a spherically converted average grain size of 1.0 μm, a distribution range of 10.5%, an aspect ratio of 2.3 and two twinned crystal faces parallel with each other.

<Preparation of EM-105~EM-108 . . . each emulsion relating to the invention>

Emulsions EM-105 through EM-108 were each prepared in almost the same manner as in the case of EM-104, except that the kinds and amounts of the oxidizing agents used therein were changed as shown in Table 1.

TABLE 1

| Number of Emulsion | Component of the Oxidizing agent used | Amount of the oxidizing agent added* |
|---|---|---|
| EM-105 | Iodine | $5.0\times10^{-6}$ mols |
| EM-106 | Iodine | $5.0\times10^{-4}$ mols |
| EM-107 | Iodine | $5.0\times10^{-3}$ mols |
| EM-108 | Iodine | $2.0\times10^{-2}$ mols |
| EM-109 | Hydrogen peroxide | $5.0\times10^{-5}$ mols |
| EM-110 | Compound [I] | $5.0\times10^{-5}$ mols |
| EM-111 | Compound [II] | $5.0\times10^{-5}$ mols |

*The amounts of the oxidizing agents added are indicated by the amounts per mol of the fine grains.

Compound [I]
$C_2H_5SO_2SNa$
Compound [II]

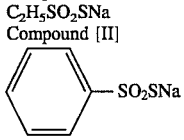

From the scanning type electron-microscopic photograph of the resulting silver halide grains, they were proved to be the low aspect ratio, twinned crystal and monodisperse type emulsion grains each having a spherically converted average grain size of 1.0 μm, a distribution range of 10.5%, an aspect ratio of 2.3 and two twinned crystal faces parallel with each other.

<Preparation of silver halide photographic light sensitive materials>

Samples 101 through 111 were each prepared in the following manner. Emulsions EM-101 through EM-111 were each subjected to the optimum spectral sensitization treatment by making use of gold sulfur sensitizing dyes and two kinds of the methanol solutions containing spectrally sensitizing dye (1) and (2). Thereafter, a dispersed solution containing the following coupler (1) was added to each of the sensitized emulsions and the resulting emulsions were coated on triacetyl cellulose supports, respectively, so that the sample 101~111 could be prepared.

Spectrally sensitizing dye (1):

Pyridium anhydro-5,5'-dichloro-3,3'-di-(3-sulfopropyl)-9-ethylthiacarbocyanine hydroxide Spectrally sensitizing dye (2):

Triethylamine anhydro-9-ethyl-3,3'-di-(3-sulfopropyl)-4,5,4',5'-dibenzothiacarbocyanine hydroxide Coupler (1)

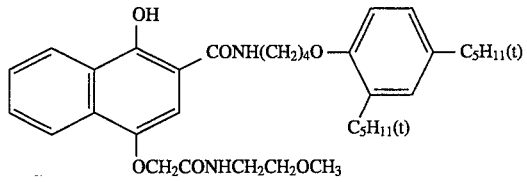

Each of the resulting samples was exposed wedgewise to a light source having a color temperature of 5,400 k°, through a glass filter (Y-48) manufactured by Toshiba, and they were each developed in the following processing steps.

| | | |
|---|---|---|
| 1. Color developing | 1 min. 45 sec. | 38.0 ± 0.1° C. |
| 2. Bleaching | 6 min. 30 sec. | 38.0 ± 3.0° C. |
| 3. Washing | 3 min. 15 sec. | 24 ~ 41° C. |
| 4. Fixing | 6 min. 30 sec. | 38.0 ± 3.0° C. |
| 5. Washing | 3 min. 15 sec. | 24.0 ~ 41° C. |
| 6. Stabilizing | 3 min. 15 sec. | 38.0 ± 3.0° C. |
| 7. Drying | | ≦50° C. |

The compositions of the processing solutions used in the above-mentioned processing. steps were as follows.

| | |
|---|---|
| [Color developer] | |
| 4-amino-3-methyl-N-ethyl-N-(β-hydroxyethyl)aniline sulfate | 4.75 g |
| Sodium sulfite, anhydrous | 4.25 g |
| Hydroxyamine.½ sulfate | 2.0 g |
| Potassium carbonate, anhydrous | 37.5 g |
| Sodium bromide | 1.3 g |
| Trisodium nitrilotriacetate, monohydrate | 2.5 g |
| Potassium hydroxide | 1.0 g |
| Add water to make | 1 liter |
| Adjust pH with sodium hydroxide to be | pH 10.0 |
| [Bleacher] | |
| Iron ammonium ethylenediaminetetraacetate | 100.0 g |
| Diammonium ethylenediaminetetraacetate | 10.0 g |
| Ammonium bromide | 150.0 g |
| Glacial acetic acid | 10.0 g |
| Add water to make | 1 liter |
| Adjust pH with aqueous ammonia to be | pH 6.0 |
| [Fixer] | |
| Ammonium thiosulfate | 175.0 g |
| Sodium sulfite, anhydrous | 8.5 g |
| Sodium metasulfite | 2.3 g |
| Add water to make | 1 liter |
| Adjust pH with acetic acid to be | pH 6.0 |
| [Stabilizer] | |
| Formalin (in an aqueous 37% solution) | 1.5 ml |
| Konidux (manufactured by Konica Corp.) | 7.5 ml |
| Add water to make | 1 liter |

Immediately after the samples were prepared, the relative fogginess, relative sensitivities and relative RMS values thereof to red light (R) were each measured. The results of the measurements will be shown in Table 2.

The above-mentioned relative fogginess is a value relative to the minimum density (Dmin), and it is indicated by a value relative to the Dmin value of Sample 101 that is regarded as a standard value of 100.

The above-mentioned relative sensitivity is a value relative to the reciprocal of an exposure amount giving a density of Dmin+0.15, and it is indicated by a value relative to the sensitivity of Sample 101 that is regarded as a standard value of 100.

The relative RMS value is to be measured at a density point of Dmin+0.15 that is the same point as the point of measuring the above-mentioned relative sensitivity.

The above-mentioned relative RMS values are obtained in the following procedures. The density of a sample is scanned, in the portion subject to measurement, by making use of a microdensitometer having a scanning aperture area of 1,800 $\mu m^2$ (or in the size of a slit width of 10 μm by a slit length of 180 μm) and equipped with a Wratten filter W-26 manufactured by Eastman Kodak Co., to obtain a standard variation difference among the density values of not less than 1,000 sampled numbers subject to the density measurements. The resulting RMS values are indicated by the values relative to the RMS value obtained from Sample 101, that is regarded as the standard value of 100. It resultingly means that the more a relative RMS value is smaller, the more the graininess is excellent.

TABLE 2

| Sample No. | Relative fogginess | Relative RMS value | Relative sensitivity |
|---|---|---|---|
| 101 (Comparison) | 100 | 100 | 100 |
| 102 (Comparison) | 99 | 100 | 100 |
| 103 (Comparison) | 97 | 95 | 105 |
| 104 (Invention) | 68 | 75 | 135 |
| 105 (Invention) | 83 | 85 | 115 |
| 106 (Invention) | 59 | 65 | 155 |
| 107 (Invention) | 64 | 75 | 140 |
| 108 (Invention) | 76 | 80 | 130 |
| 109 (Invention) | 81 | 83 | 120 |
| 110 (Invention) | 70 | 77 | 135 |
| 111 (Invention) | 72 | 80 | 130 |

As shown in Table 2 above, the silver halide emulsions of the invention were clearly proved to be low in fogginess, excellent in graininess and high in sensitivity, as compared to the emulsions prepared in the conventional techniques.

EXAMPLE 2

<Preparation of EM-201 . . . a comparative emulsion>

Emulsion EM-201 was prepared by making use of silver bromide seed emulsion EM-T2 comprising silver halide grains (having a spherically converted grain size of 0.3 μm) having two twinned crystal faces parallel with each other, and the following 7 kinds of solutions.

| | |
|---|---|
| (Solution $A_2$) | |
| Ossein gelatin | 268.2 g |
| Distilled water | 4.0 liters |
| Seed emulsion (EM-T2) | 0.286 mols |
| An aqueous 28 wt % ammonia solution | 528.0 ml |
| An aqueous 56 wt % acetic acid solution | 795.0 ml |
| Add distilled water to make | 5,930.0 ml |
| (Solution $B_2$) | |
| An aqueous 3.5 N ammoniacal silver nitrate solution prepared by adjusting the pH of solution $B_2$ with ammonium nitrate to be pH 9.0 | 3,898 mols |

-continued

| | |
|---|---|
| (Solution $C_2$) | |
| An aqueous 3.5 N potassium bromide solution containing 4.0 wt % gelatin | |
| (Solution $D_2$) | |
| A fine grain emulsion containing 3.0 wt % gelatin and silver iodide grains (having an average grain size of 0.05 μm), that was prepared in the same manner as in MC-1, provided that the temperature for forming the fine grains was controlled to be 40° C. | 0.844 mols |
| (Solution $E_2$) | |
| A fine grain emulsion containing silver iodobromide grains (having an average grain size of 0.03 μm) containing 1 mol % silver iodide | 5.568 mols |

The preparation procedures will be detailed below.

(Solution $E_2$-1)

An aqueous 8.8% gelatin solution (Solution $E_2$-2)

An aqueous 3.5N silver nitrate solution containing 2.0% silver nitrate (Solution $Ez_2$-3) .

A mixing chamber was equipped with a high-speed stirring propeller for forming fine grains, that was separately provided to the outside of a reaction chamber for making a reaction of an aqueous potassium bromide/iodide solution containing 1.0 mol % potassium iodide. Each of aqueous solutions of $E_2$-1 through $E_2$-3 was added into the mixing chamber continuously in a triple-jet method at the flow rates of $E_2$-1: $E_2$-2: $E_2$-3=2.5: 1.0: 1.0, respectively. During the addition of the solutions, the temperature inside the mixing chamber was controlled to be 30° C. Each of the solutions added into the mixing chamber was immediately reacted together by the high-speed stirring propeller and was then discharged continuously from the mixing chamber in the form of a silver halide fine grain emulsion. The resulting fine grain emulsion was transported into a preparation tank and the pH and pAg thereof were adjusted, if required.

The preparation of the fine grain emulsions such as mentioned above are carried out in parallel with the process for growing the objective grains and, when occasion demands, the fine grain emulsions are supplied from the preparation tank into the reaction chamber during the growth of the grains so that the emulsion grains can be grown up.

(Solution $F_2$)

An aqueous 1.75N potassium bromide solution (Solution $G_2$)

An aqueous 56 wt % acetic acid solution

Into solution $A_2$ kept at 70° C. in a reaction chamber, solutions $B_2$, $C_2$ and $D_2$ were each added in a double-jet method by taking 142 minutes. Successively, solution $E_2$ was independently added at a constant adding rate, so that the seed crystals were each grown up to have a grain size of 1.0 μm (that is, in the grain size converted into the diameter of a globe having the same area of the subject grain).

The adding rates of solutions $B_2$ and $C_2$ were each controlled to be suitable by changing these rates time-functionwise to meet the critical growth rate, but neither to produce any small grains other than the seed crystals being grown nor to polydisperse them in an Ostwald ripening reaction. Solution $D_2$, that is a silver iodide fine grain emulsion, was supplied by changing the supply rate thereof (in mol ratio) to an aqueous ammoniacal silver nitrate solution to meet the grain sizes (or to meet the adding time) as shown in Table 3, so that a core/shell type silver halide emulsion having a multicoated structure could be prepared.

By making use of solutions $F_2$ and $G_2$, the pAg and pH were controlled during the growth of the grains as shown in Table 3. The pAg and pH were measured by making use of a silver sulfide electrode and a glass electrode in an ordinary method.

After completing the grain formation, the desalting treatment was carried out according to the method described in JP Application No. 3-41314/1991. After that, the redispersion treatment was carried out by adding gelatin, and the pH and pAg thereof were adjusted to be 5.80 and 8.06, respectively.

From the scanning type electron-microscopic photographs of the resulting emulsion grains, the resulting emulsion was proved to be the twinned crystal and monodisperse type emulsion having an average grain size of 1.0 μm (that was converted into the spherical grain size), a distribution range of 10.3%, a low aspect ratio of 1.4 and two twinned crystal faces parallel with each other.

TABLE 3

| Adding time (min) | Grain size (μm) | Mol ratio of solution $D_2$ | pH | pAg |
|---|---|---|---|---|
| | Core section | | | |
| 0.0 | 0.300 | 10.3% | 7.2 | 7.8 |
| 23.1 | 0.423 | 10.3 | 7.2 | 7.8 |
| 38.0 | 0.489 | 10.3 | 7.2 | 7.8 |
| 50.1 | 0.533 | 30.0 | 7.2 | 7.8 |
| 82.6 | 0.654 | 30.0 | 7.2 | 7.8 |
| | Shell section | | | |
| 82.6 | 0.654 | 30.0 | 6.5 | 9.4 |
| 112.7 | 0.704 | 10.3 | 6.5 | 9.4 |
| 122.0 | 0.721 | 10.3 | 6.5 | 9.4 |
| 142.0 | 0.780 | 7.7 | 6.5 | 9.4 |

<Preparation of EM-202 . . . An emulsion relating to the invention>

Emulsion EM-202 was prepared in almost the same manner as in the case of EM-201, except that, before the addition of silver iodobromide fine grains (in the form of solution $E_2$), a reaction chamber was added therein with a methanol solution containing iodine in an amount of $3.0\times10^3$ mols, as an oxidizing agent.

<Preparation of EM-203 . . . An emulsion relating to the invention>

Emulsion EM-203 was prepared in almost the same manner as in the case of EM-201, except that solution $E_3$ containing an oxidizing agent was used in place of solution $E_2$. Solution $E_3$ was prepared by making use of the following 3 kinds of solutions, as in the case of solution $E_2$.

(Solution $E_3$-1)

An aqueous solution containing iodine in an amount of $3.0\times10^{-3}$ mols and gelatin in a proportion of 8.8%

(Solution $E_3$-2)

An aqueous 3.5N silver nitrate solution containing nitric acid in a proportion of 2.0%

(Solution $E_3$-3)

An aqueous potassium bromide/iodide solution containing potassium iodide in a proportion of 1.0 mol %

<Preparation of EM-204 . . . An emulsion relating to the invention>

Emulsion EM-204 was prepared in almost the same manner as in the case of Em-201, except that a methanol solution containing iodine in an amount of $5.6\times10^{-3}$ mols was added, as an oxidizing agent, into solution $A_2$ contained in a reaction chamber.

<Preparation of EM-205 . . . An emulsion relating to the invention>

Emulsion EM-205 was prepared in almost the same manner as in the case of Em-201, except that solutions $D_3$ and $E_3$ were used in place of solutions $D_2$ and $E_2$.

Solution $D_3$ was prepared in almost the same manner as in the case of solution $D_2$, except that an aqueous gelatin solution containing a methanol solution containing iodine in an amount of $2.6\times10^{-3}$ mols was used as an oxidizing agent.

<Preparation of EM-206 . . . An emulsion relating to the invention>

Emulsion EM-206 was prepared in almost the same manner as in the case of Em-201, except that solution $E_2$ was added in an amount of 2.784 mols and solution $E_3$ was then added in an amount of 2.784 mols.

<Preparation of EM-207 . . . An emulsion relating to the invention>

Emulsion EM-207 was prepared in almost the same manner as in the case of Em-201, except that, before adding solution $E_2$, solution $E_3$ was added in an amount of 2.784 mols and solution $E_2$ was then successively added in an amount of 2.784 mols.

From the electron-microscopic observation of the resulting EM-202 through EM-207, they were proved to be the twinned crystal and monodisperse type emulsion having an average grain size, a distribution range and an aspect ratio, each equivalent to those of EM-201 and two twinned crystal faces parallel with each other.

(Preparation of silver halide photographic light sensitive materials)

Each of the resulting emulsions EM-202 through EM-207 was subjected to the optimum gold-sulfur sensitization. By making these sensitized emulsions and triacetyl cellulose film supports, a multilayered color photographic light sensitive material sample was prepared by forming thereon each of the layers having the following compositions in the order from the support side.

The constitution of multilayered color photographic light sensitive material [Sample-201] was as follows.

The amounts of the compositions added thereto are indicated by grams per sq.meter, unless otherwise expressly stated. The amounts of silver halide and colloidal silver are indicated by the silver contents thereof. The amounts of the sensitizing dyes used therein are indicated by mol numbers per mol of silver halide used.

| | |
|---|---|
| Layer 1: An antihalation layer | |
| Black colloidal silver | 0.16 |
| UV absorbent (UV-1) | 0.20 |
| High boiling organic solvent (Oil-1) | 0.16 |
| Gelatin | 1.23 |
| Layer 2: An intermediate layer | |
| Compound (SC-1) | 0.15 |
| High boiling organic solvent (Oil-2) | 0.17 |
| Gelatin | 1.27 |
| Layer 3: A low-speed red-sensitive layer | |
| Silver iodobromide emulsion (having an average grain size of 0.38 μm and a silver iodide content of 8.0 mol %) | 0.50 |
| Silver iodobromide emulsion (having an average grain size of 0.27 μm and a silver iodide content of 2.0 mol %) | 0.21 |
| Sensitizing dye (SD-1) | $2.8\times10^{-4}$ |
| Sensitizing dye (SD-2) | $1.9\times10^{-4}$ |

| | |
|---|---|
| Sensitizing dye (SD-3) | $1.9 \times 10^{-5}$ |
| Sensitizing dye (SD-4) | $1.0 \times 10^{-4}$ |
| Cyan coupler (C-1) | 0.48 |
| Cyan coupler (C-2) | 0.14 |
| Colored cyan coupler (CC-1) | 0.021 |
| DIR compound (D-1) | 0.020 |
| High boiling solvent (Oil-1) | 0.53 |
| Gelatin | 1.30 |
| Layer 4: A medium-speed red-sensitive layer | |
| Silver iodobromide emulsion (having an average grain size of 0.52 μm and a silver iodide content of 8.0 mol %) | 0.62 |
| Silver iodobromide emulsion (having an average grain size of 0.38 μm and a silver iodide content of 8.0 mol %) | 0.27 |
| Sensitizing dye (SD-1) | $2.3 \times 10^{-4}$ |
| Sensitizing dye (SD-2) | $1.2 \times 10^{-4}$ |
| Sensitizing dye (SD-3) | $1.6 \times 10^{-5}$ |
| Sensitizing dye (SD-4) | $1.2 \times 10^{-4}$ |
| Cyan coupler (C-1) | 0.15 |
| Cyan coupler (C-2) | 0.18 |
| Colored cyan coupler (CC-1) | 0.030 |
| DIR compound (D-1) | 0.013 |
| High boiling solvent (Oil-1) | 0.30 |
| Gelatin | 0.93 |
| Layer 5: A high-speed red-sensitive layer | |
| [EM-201] | 1.27 |
| Sensitizing dye (SD-1) | $1.3 \times 10^{-4}$ |
| Sensitizing dye (SD-2) | $1.3 \times 10^{-4}$ |
| Sensitizing dye (SD-3) | $1.6 \times 10^{-5}$ |
| Cyan coupler (C-2) | 0.12 |
| Colored cyan coupler (CC-1) | 0.013 |
| High boiling solvent (Oil-1) | 0.14 |
| Gelatin | 0.91 |
| Layer 6: An intermediate layer | |
| Compound (SC-1) | 0.09 |
| High boiling organic solvent (Oil-2) | 0.11 |
| Gelatin | 0.80 |
| Layer 7: A low-speed green-sensitive layer | |
| Silver iodobromide emulsion (having an average grain size of 0.38 μm and a silver iodide content of 8.0 mol %) | 0.61 |
| Silver iodobromide emulsion (having an average grain size of 0.27 μm and a silver iodide content of 2.0 mol %) | 0.20 |
| Sensitizing dye (SD-4) | $7.4 \times 10^{-5}$ |
| Sensitizing dye (SD-5) | $6.6 \times 10^{-4}$ |
| Magenta coupler (M-1) | 0.18 |
| Magenta coupler (M-2) | 0.44 |
| Colored magenta coupler (CM-1) | 0.12 |
| High boiling solvent (Oil-2) | 0.75 |
| Gelatin | 1.95 |
| Layer 8: A medium-speed green-sensitive layer | |
| Silver iodobromide emulsion (having an average grain size of 0.59 μm and a silver iodide content of 8.0 mol %) | 0.87 |
| Sensitizing dye (SD-6) | $2.4 \times 10^{-4}$ |
| Sensitizing dye (SD-7) | $2.4 \times 10^{-4}$ |
| Magenta coupler (M-1) | 0.058 |
| Magenta coupler (M-2) | 0.13 |
| Colored magenta coupler (CM-1) | 0.070 |
| DIR compound (D-2) | 0.025 |
| DIR compound (D-3) | 0.002 |
| High boiling solvent (Oil-2) | 0.50 |
| Gelatin | 1.00 |
| Layer 9: A high-speed green-sensitive layer | |
| [EM-201] | 1.27 |
| Sensitizing dye (SD-6) | $1.4 \times 10^{-4}$ |
| Sensitizing dye (SD-7) | $1.4 \times 10^{-4}$ |
| Magenta coupler (M-2) | 0.084 |
| Magenta coupler (M-3) | 0.064 |
| Colored magenta coupler (CM-1) | 0.012 |

| | |
|---|---|
| High boiling solvent (Oil-1) | 0.27 |
| High boiling solvent (Oil-2) | 0.012 |
| Gelatin | 1.00 |
| Layer 10: A yellow filter layer | |
| Yellow colloidal silver | 0.08 |
| Color stain preventive (SC-2) | 0.15 |
| Formalin scavenger (HS-1) | 0.20 |
| High boiling solvent (Oil-2) | 0.19 |
| Gelatin | 1.10 |
| Layer 11: An intermediate layer | |
| Formalin scavenger (HS-1) | 0.20 |
| Gelatin | 1.60 |
| Layer 12: A low-speed blue-sensitive layer | |
| Silver iodobromide emulsion (having an average grain size of 0.38 μm and a silver iodide content of 8.0 mol %) | 0.22 |
| Silver iodobromide emulsion (having an average grain size of 0.27 μm and a silver iodide content of 2.0 mol %) | 0.03 |
| Sensitizing dye (SD-8) | $4.9 \times 10^{-4}$ |
| Yellow coupler (Y-1) | 0.75 |
| DIR compound (D-1) | 0.010 |
| High boiling solvent (Oil-2) | 0.30 |
| Gelatin | 1.20 |
| Layer 13: A medium-speed blue-sensitive layer | |
| Silver iodobromide emulsion (having an average grain size of 0.59 μm and a silver iodide content of 8.0 mol %) | 0.30 |
| Sensitizing dye (SD-8) | $1.6 \times 10^{-4}$ |
| Sensitizing dye (SD-9) | $7.2 \times 10^{-5}$ |
| Yellow coupler (Y-1) | 0.10 |
| DIR compound (D-1) | 0.010 |
| High boiling solvent (Oil-2) | 0.046 |
| Gelatin | 0.47 |
| Layer 14: A high-speed blue-sensitive layer | |
| [EM-201] | 0.85 |
| Sensitizing dye (SD-8) | $7.3 \times 10^{-5}$ |
| Sensitizing dye (SD-9) | $2.8 \times 10^{-5}$ |
| Yellow coupler (Y-1) | 0.11 |
| High boiling solvent (Oil-2) | 0.046 |
| Gelatin | 0.80 |
| Layer 15: Protective layer 1 | |
| Silber iodobromide emulsion (having an average grain size of 0.08 μm and a silver iodide content of 1.0 mol %) | 0.40 |
| UV absorbent (UV-1) | 0.065 |
| UV absorbent (UV-2) | 0.10 |
| High-boiling solvent (Oil-1) | 0.07 |
| High-boiling solvent (Oil-3) | 0.07 |
| Formalin scavenger (HS-1) | 0.40 |
| Gelatin | 1.31 |
| Layer 16: Protective layer 2 | |
| Alkali-soluble matting agent (having an average particle size of 2 μm) | 0.15 |
| Polymethyl methacrylate (having an average particle size of 3 μm) | 0.04 |
| Lubricant (WAX-1) | 0.04 |
| Gelatin | 0.55 |

Besides the above-given compositions, coating aid Su-1, dispersion aid Su-2, a viscosity controller, layer-hardeners H-1 and H-2, stabilizer ST-1, two kinds of antifoggants AF-1 and AF-2 having the weight average molecular weights of 10,000 and 1,100,000, respectively, and antiseptic DI-1 were each added thereto. The amount of DI-1 added thereto was 9.4 mg/m$^2$.

The chemical structures of the compounds applied to the above-mentioned sample will be given below.

C-1
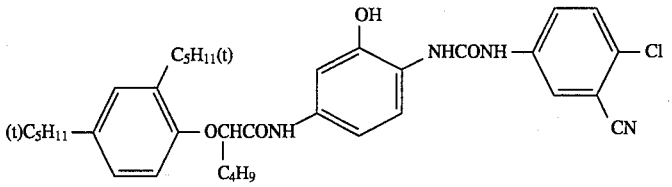
C-2
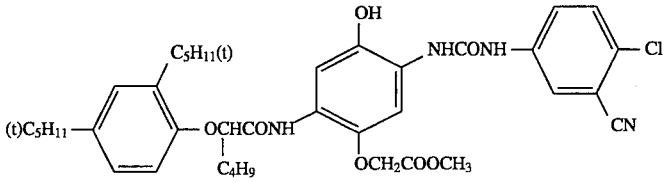
M-1
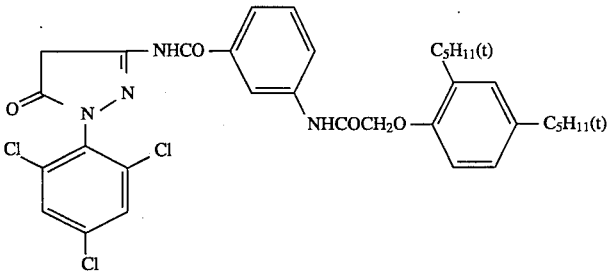
M-2
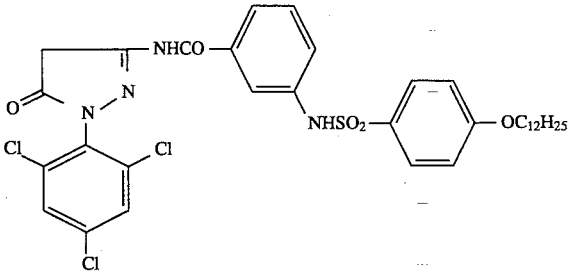
M-3
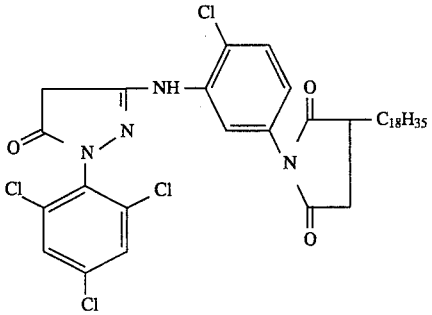
Y-1
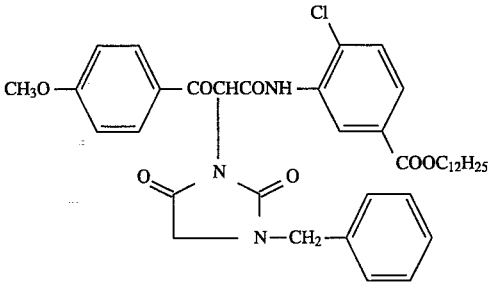
CC-1
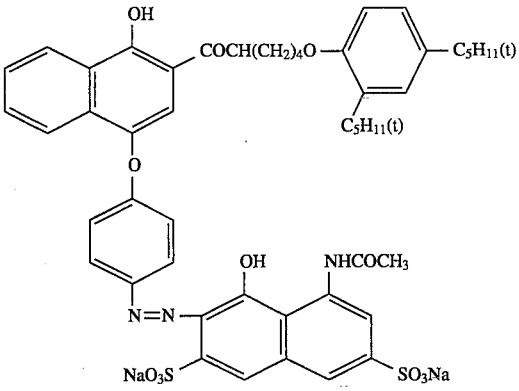

-continued
CM-1
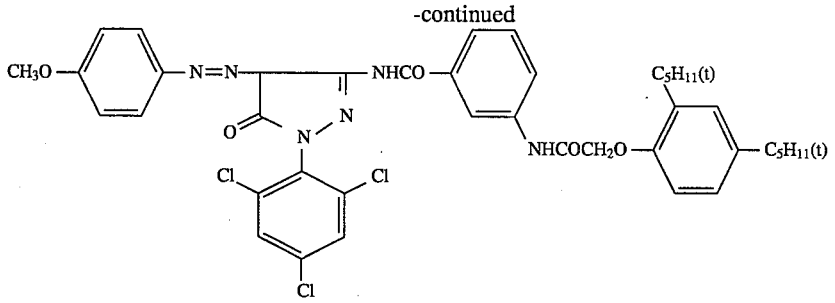
D-1
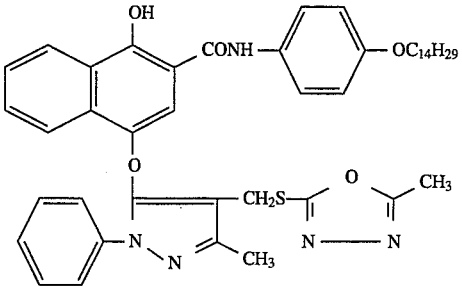
D-2
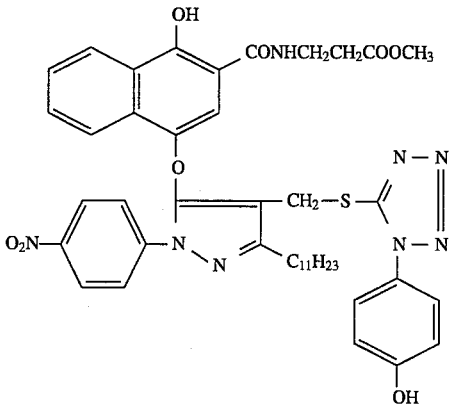
D-3
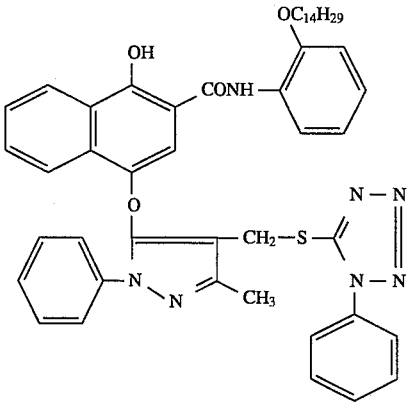
Oil-1
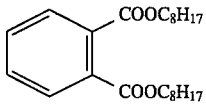
Oil-2
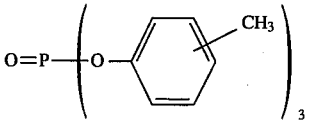
Oil-3
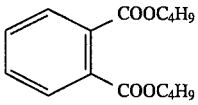
SC-1
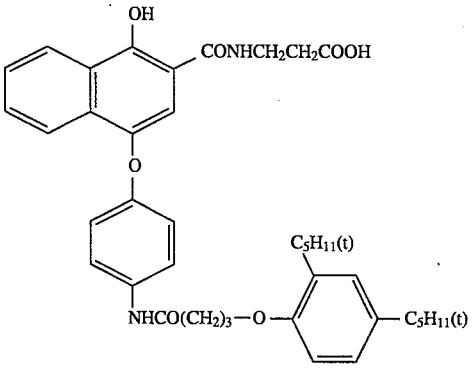
SC-2
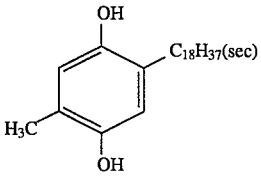

-continued
UV-1
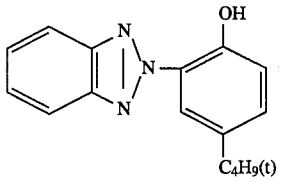
UV-2
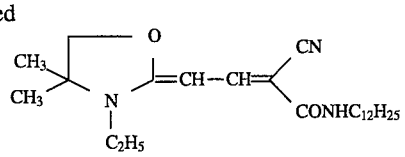
WAX-1
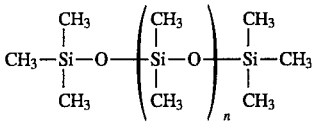
weight-average molecular weight: Mw = 3,000
SU-1
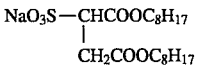
SU-2
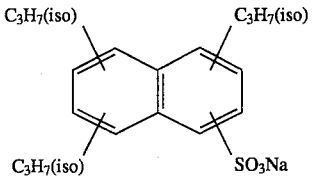
HS-1
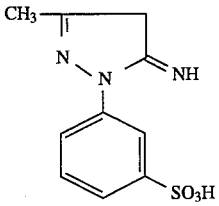
SD-1
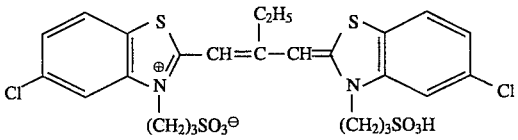
SD-2
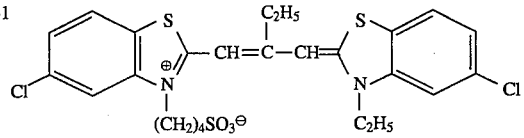
SD-3
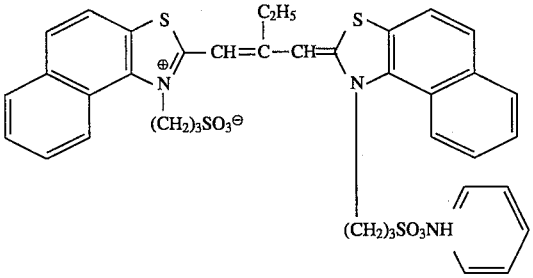
SD-4
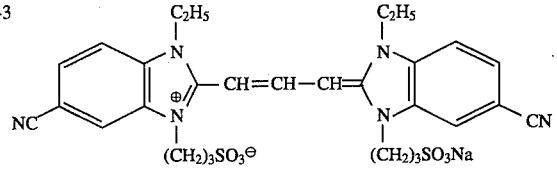
SD-5
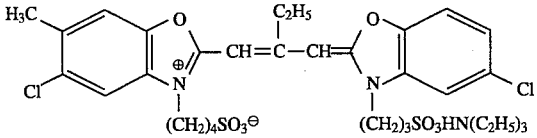
SD-6
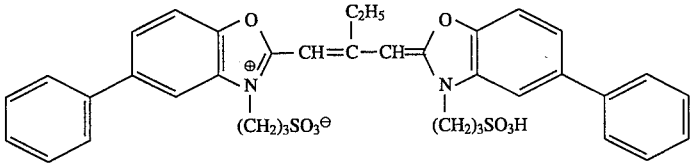
SD-7
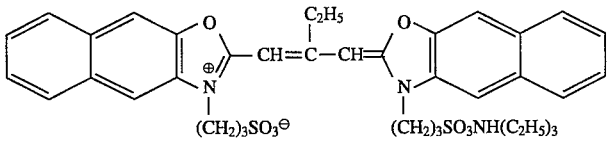
SD-8
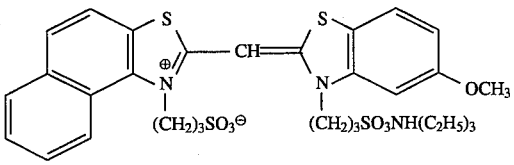

-continued

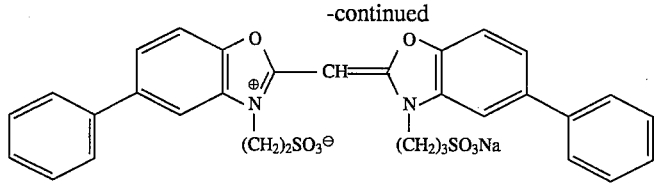

SD-9

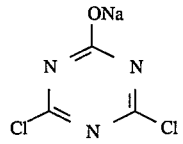

H-1

$(CH_2{=}CHSO_2CH_2)_2O$

H-2

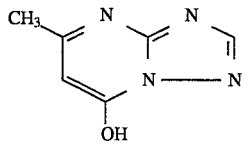

ST-1

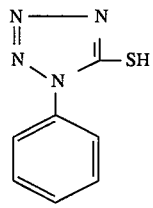

AF-1

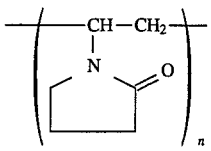

n: polymerization degree

AF-2

(A mixture of the following 3 components)

DI-1

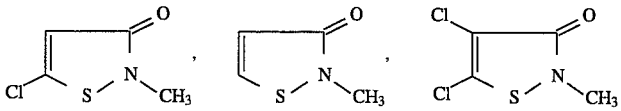

(Component A) (Component B) (Component C)

(Component A:B:C = 50:46:4 (in mol ration)

Next, samples 202 through 207 were each prepared in the same manner as in sample 201, except that silver iodobromide emulsions EM-201 used in Layers 5, 9 and 14 were replaced by emulsions EM-202 through EM-207, respectively.

The resulting samples were each exposed wedgewise to white light and were then developed in the following processing steps, respectively.

| | | |
|---|---|---|
| 1. Color developing | 3 min. 15 sec. | 38.0 ± 0.1° C. |
| 2. Bleaching | 6 min. 30 sec. | 38.0 ± 3.0° C. |
| 3. Washing | 3 min. 15 sec. | 24.0 ~ 41° C. |
| 4. Fixing | 6 min. 30 sec. | 38.0 ± 3.0° C. |
| 5. Washing | 3 min. 15 sec. | 24.0 ~ 41° C. |
| 6. Stabilizing | 3 min. 15 sec. | 38.0 ± 3.0° C. |
| 7. Drying | | ≦50° C. |

The compositions of the processing solutions used in the above-mentioned processing steps were as same as those used in Example 1.

As in Example 1, the resulting samples were each exposed to red light (R), green light (G) and blue light (B), and the relative figginess, relative sensitivities and relative RMS values of the exposed samples were each measured immediately after preparing the samples, respectively. Among the measurements results, the results obtained by exposing each sample to green light (G) will be shown in Table 4.

The above-mentioned relative fogginess is a value relative to the minimum density (Dmin), and it is indicated by a value relative to the Dmin value of Sample 201 that is regarded as a standard value of 100.

The above-mentioned relative sensitivity is a value relative to the reciprocal of an exposure amount giving a density of Dmin+0.15, and it is indicated by a value relative to the sensitivity of Sample 201 that is regarded as a standard value of 100.

The above-mentioned relative RMS value is indicated by a value relative to the RMS value of sample 201 that is regarded as a standard value of 100. For measuring the relative RMS values, Wratten filters W-26, W-99 and W-47 were used in the R, G and B measurements, respectively.

TABLE 4

| Sample No. | Emulsion No. | Relative fogginess | Relative RMS value | Relative sensitivity |
|---|---|---|---|---|
| 201 (Comparison) | EM-201 | 100 | 100 | 100 |
| 202 (Invention) | EM-202 | 86 | 89 | 121 |
| 203 (Invention) | EM-203 | 83 | 85 | 128 |
| 204 (Invention) | EM-204 | 71 | 77 | 143 |
| 205 (Invention) | EM-205 | 65 | 72 | 151 |
| 206 (Invention) | EM-206 | 89 | 92 | 115 |
| 207 (Invention) | EM-207 | 92 | 94 | 112 |

As is obvious from the results shown in Table 4, it was apparently confirmed that the effects of the invention can be displayed on the fogginess, graininess and sensitivity, as same as in the case of Example 1.

From the comparison of samples 201, 202 with samples 203, 204, it was also proved that the effects of the invention were more greatly displayed in the silver halide emulsion prepared in embodiment <B> than in embodiment <A> each described hereunder.

What is claimed is:

1. A method for preparing a silver halide photographic emulsion comprising light-sensitive silver halide grains, which comprises the steps of:

(a) supplying an aqueous silver salt solution, an aqueous halide solution and an aqueous protective colloid solution to a mixer vessel, at a pH of 5.6 or less, to form a fine grain emulsion comprising silver halide fine grains having a grain size of not larger than 0.05 μm;

(b) supplying the fine grain emulsion to a reactor vessel as a source of silver halide; and forming therein the photographic emulsion comprising light-sensitive silver halide grains, in the presence of an oxidizing agent.

2. The method of claim 1, wherein in the step of (b), the reactor vessel contains an emulsion comprising seed grains prior to supplying of the fine grain emulsion.

3. A method for preparing a silver halide photographic emulsion comprising light-sensitive silver halide grains, which comprises the steps of:

(a) supplying an aqueous silver salt solution, an aqueous halide solution and an aqueous protective colloid solution to a mixer vessel, at a pH of 5.6 or less, to form a fine grain emulsion comprising silver halide fine grains having a grain size of not larger than 0.05 μm; and (b) supplying the fine grain emulsion to a reactor vessel as a source of silver halide; and forming therein the photographic emulsion comprising light-sensitive silver halide grains, in the presence of an oxidizing agent; and, wherein, after the step of (a) and before the step of (b), the step of transferring said fine grain emulsion to an adjustment vessel to adjust pAg or pH of the fine grain emulsion to a prescribed pAg or pH value.

4. A method for preparing a silver halide photographic emulsion comprising light-sensitive silver halide grains, which comprises the steps of:

(a) supplying an aqueous silver salt solution, an aqueous halide solution and an aqueous protective colloid solution to a mixer vessel in the presence of a first oxidizing agent to form a fine grain emulsion comprising silver halide fine grains having a grain size not larger than 0.05 μm; and (b) supplying the fine grain emulsion formed in the step of (a) to a reactor vessel and forming therein the photographic emulsion comprising light-sensitive silver halide grains in the presence of a second oxidizing agent which is identical to the first oxidizing agent or is a different oxidizing agent.

5. The method of claim 4, wherein said fine grains are formed at a pH of 5.6 or less.

6. The method of claim 4, further comprising, after the step of (a) and before the step of (b), the step of transferring said fine grain emulsion to an adjustment vessel to adjust pAg or pH of the fine grain emulsion to a prescribed pAg or pH value.

7. The method of claim 4, wherein in the step of (b), the reactor vessel contains an emulsion comprising seed grains prior to supplying of the fine grain emulsion.

8. The method of claim 4, wherein said first and said second oxidizing agent are selected from ozone, hydrogen peroxide, peroxy acid salts, halogens, thiosulphonic acid salts, quinones and organic peroxides.

* * * * *